US008861745B2

(12) United States Patent
Yen et al.

(10) Patent No.: US 8,861,745 B2
(45) Date of Patent: Oct. 14, 2014

(54) WIND NOISE MITIGATION

(75) Inventors: Kuan-Chieh Yen, Northville, MI (US); Xuejing Sun, Rochester Hills, MI (US); Jeffrey S. Chisholm, Royal Oak, MI (US)

(73) Assignee: Cambridge Silicon Radio Limited (GB)

( * ) Notice: Subject to any disclaimer, the term of this patent is extended or adjusted under 35 U.S.C. 154(b) by 840 days.

(21) Appl. No.: 12/958,029

(22) Filed: Dec. 1, 2010

(65) Prior Publication Data

US 2012/0140946 A1 Jun. 7, 2012

(51) Int. Cl.
*H04R 3/00* (2006.01)
*H04R 1/10* (2006.01)

(52) U.S. Cl.
CPC ..... *H04R 1/1083* (2013.01); *H04R 2420/07* (2013.01); *H04R 3/005* (2013.01); *H04R 2410/07* (2013.01)
USPC ..... 381/92; 381/93; 381/94.1; 381/94.3; 381/94.7; 381/94.8; 381/13; 381/56; 381/317; 700/94; 704/225; 704/226; 704/233; 704/218

(58) Field of Classification Search
USPC ..... 381/92, 93, 94.1, 94.3, 94.7, 94.8; 704/225, 226, 233, 218; 700/94
See application file for complete search history.

(56) References Cited

U.S. PATENT DOCUMENTS

| | | | | |
|---|---|---|---|---|
| 7,171,008 | B2 * | 1/2007 | Elko | 381/92 |
| 7,464,029 | B2 | 12/2008 | Visser et al. | |
| 7,693,712 | B2 * | 4/2010 | Gaeta et al. | 704/226 |
| 7,761,291 | B2 * | 7/2010 | Renevey et al. | 704/225 |
| 7,885,420 | B2 * | 2/2011 | Hetherington et al. | 381/94.2 |
| 8,121,311 | B2 * | 2/2012 | Hetherington | 381/93 |
| 2004/0165736 | A1 | 8/2004 | Hetherington et al. | |
| 2005/0094735 | A1 * | 5/2005 | Crawford | 375/257 |
| 2007/0030989 | A1 * | 2/2007 | Kates | 381/317 |
| 2009/0175466 | A1 * | 7/2009 | Elko et al. | 381/94.2 |
| 2009/0271187 | A1 * | 10/2009 | Yen et al. | 704/226 |

FOREIGN PATENT DOCUMENTS

| | | | |
|---|---|---|---|
| WO | 2007/132176 | A1 | 11/2007 |
| WO | WO 2009042385 | A1 * | 4/2009 |

OTHER PUBLICATIONS

Simmer et al, Suppression of coherent and incoherent noise using a microphone array, 1994.*
Cohen, Analysis of two channel generalized sidelobe canceler GSC with post filtering,IEEE, 2003.*
Wu et al, Array signal number detection for coherent and uncoherent signals in unknown noise environment, IEEE, 1994.*
Pham et al, a family of coherence based multi microphone speech enhancment systems,2003.*
Bouquin et al, using the coherence function for noise reduction,1992.*

* cited by examiner

*Primary Examiner* — Davetta W Goins
*Assistant Examiner* — Kuassi Ganmavo
(74) *Attorney, Agent, or Firm* — John W. Branch; Lowe Graham Jones PLLC

(57) ABSTRACT

A method of compensating for noise in a receiver having a first receiver unit and a second receiver unit, the method includes receiving a first transmission at the first receiver unit, the first transmission having a first signal component and a first noise component; receiving a second transmission at the second receive unit, the second transmission having a second signal component and a second noise component; determining whether the first noise component and the second noise component are incoherent and; only if it is determined that the first and second noise components are incoherent, processing the first and second transmissions in a first processing path, wherein the first processing path is configured to compensate for incoherent noise.

26 Claims, 5 Drawing Sheets

WIND NOISE MITIGATION

BACKGROUND OF THE INVENTION

Wind buffeting noise is created by the action of wind across the surface of a microphone or other receiver device. Such turbulent air flow causes' local pressure fluctuations and sometimes even saturates the microphone. This can make it difficult for the microphone to detect a desired signal. The time-varying wind noise created under such situations is commonly referred to as "buffeting". Wind buffeting noise in embedded microphones, such as those found in cell phones, Bluetooth headsets, and hearing aids, is known to produce major acoustic interference and can severely degrade the quality of an acoustic signal.

Wind buffeting mitigation has been a very difficult problem to tackle effectively. Commonly, mechanical-based solutions have been implemented. For example, in WO 2007/132176 the plurality of transducer elements in the communication device are covered by a thin acoustic resistive material. However, mechanical-based solutions are not always practical or feasible in every situation.

Voice communications systems have traditionally used single-microphone noise reduction (NR) algorithms to suppress noise and improve the audio quality. Such algorithms, which depend on statistical differences between speech and noise, provide effective suppression of stationary (i.e. non time varying) noise, particularly where the signal to noise ratio (SNR) is moderate to high. However, the algorithms are less effective where the SNR is very low and the noise is dynamic (or non-stationary), e.g. wind buffeting noise. Special single microphone wind noise reduction algorithms have been proposed in "Coherent Modulation Comb Filtering for Enhancing Speech in Wind Noise," by Brian King and Les Atlas, "Wind Noise Reduction Using Non-negative Sparse Coding," by Mikkel N Schmidt, Jan Larsen and Fu-Tien Hsaio, and US 2007/0030989. When the wind noise is severe, single channel systems generally either resort to total attenuation of the incoming signal or completely cease to process the incoming signal.

The limitation imposed on the single channel solutions can be mitigated when multiple microphones are available. As wind buffeting noise is caused by local turbulence surrounding microphones, the wind noise observed by one microphone generally occupies a different time-frequency space to wind noise observed by another microphone. Therefore, the correlation between the wind buffeting noise components received at the two microphones is generally low. In contrast, when there is no wind buffeting, two microphones that are closely spaced are subject to the same acoustic field and thus the acoustic signals (speech, music, or background noise) observed by the microphones are typically highly correlated. Many algorithms such as those disclosed in U.S. Pat. No. 7,464,029 and US 2004/0165736 have taken advantage of this by switching to the one of the two microphones that has the lower power at any given time to mitigate the impact of wind buffeting noise.

In addition to handling wind buffeting noise, there are many approaches directed to how to use multiple microphones to mitigate the negative impacts of acoustic noise in an environment on a received signal. These algorithms can be categorized into blind source separation (BSS) and independent component analysis (ICA), beamforming, coherence based filtering, direction of arrival filtering techniques and various combinations thereof. The following is a brief overview of each type of technique.

BSS/ICA

Blind source separation (BSS) refers to techniques that estimate original source signals using only the information of the received mixed signals. Some examples of how BSS techniques can be used to mitigate wind noise are illustrated in U.S. Pat. No. 7,464,029, in "Blind Source Separation combining Frequency-Domain ICA and Beamforming", by H. Saruwatari, S. Kurita, and K. Takeda and in US 2009/0271187. BSS is a statistical technique that is used to estimate a set of linear filter coefficients for applying to a received signal. When using BSS, it is assumed that the original noise sources are statistically independent and so there is no correlation between them. Independent component analysis (ICA) is another statistical technique used to separate sound signals from noise sources. ICA can therefore be used in combination with BSS to solve the BSS statistical problem. BSS/ICA based techniques can achieve a substantial amount of noise reduction when the original sources are independent.

However, in real-life scenarios, there will often be reverberations and echoes of particular signals in the environment that are detected by the microphones. Therefore some noise signals may have some correlation. Also, BSS/ICA techniques commonly require that there are as many microphones as signal sources in order that the statistical problem can be solved accurately. In practice, however, there are often more signal sources than microphones. This causes the formation of an under-deterministic set of equations to solve and can negatively impact the separation performance of the BSS/ICA algorithms. Problems such as source permutation and temporarily active sources also pose challenges to the robustness of BSS/ICA algorithms. Furthermore, since BSS/ICA algorithms rely on statistical assumptions to estimate the required de-mixing transformation for separating the signals, the presence of incoherent noise such as local wind turbulence often makes the required de-mixing transformation time-varying and thus hard to estimate. When the incoherent noise is strong, the calculated filter coefficients can diverge. Therefore, the algorithms' ability to separate other coherent signals is hampered.

Beamforming

Beamforming is another widely used multi-microphone noise suppression technique. The basics of the technique are described in "Beamforming: A versatile Approach to Spatial Filtering" by B. D. Van Veen and Kevin Buckley. Like BSS/ICA, beamforming is a statistical technique. Beamforming techniques rely on the assumption that the unwanted noise components are unlikely to be originating from the same direction as the desired signal. Therefore, by imposing several spatial constraints, the desired signal source can be targeted and the signal to noise ratio (SNR) can be improved. The spatial constraints may be implemented in several different ways. Typically, however, an array of microphones is configured to receive a signal. Each microphone is sampled and a desired spatial selectivity is achieved by combining the sampled microphone signals together. The sampled microphone signals can be combined together either with an equal weighting or with an unequal weighting. The simplest type of beamformer is a delay-and-sum beamformer. In a delay-and-sum beamformer, the signal received at each microphone is delayed for a time t before being summed together in a signal processor. The delay shifts the phase of the signal received at that microphone so that when each contribution is summed, the summed signal has a strong directional component. In this example, each received signal is given an equal weight. In the simplest case, the model assumes a scenario in which each microphone receives the same signal and there is no correlation between the noise signals. More complex beamformers can be developed by assigning different weights to each received signal. For delay-and-sum beamformers, the microphone array gain, which is a performance measurement that represents the ratio of the SNR at the output of the array to the average SNR of the microphone signals, depends on the number of microphones.

The performance of beamforming algorithms is limited when the number of microphones in the array is small or when the distance between microphones is short relative to the wavelength of signal in the intended frequency range. This later condition is frequently true for applications such as Bluetooth headsets. Therefore, the use of beamforming algorithms is not commonly used in Bluetooth headsets.

Coherence-Based Approach

Coherence-based techniques are another subclass of microphone array signal processing using multiple microphones.

If the signals captured by the two microphones are denoted as $x_1(n)$ and $x_2(n)$ in the time domain, the coherence function between the two signals at frequency bin k is defined as:

$$Coh(k) = \frac{|E\{X_1(k)X_2*(k)\}|^2}{E\{|X_1(k)|^2\}E\{|X_2(k)|^2\}} \quad (1)$$

where E{ } denotes expectation value, * denotes complex conjugate. $X_i(k)$ is the frequency-domain representation of $x_i(n)$ at frequency bin k and is assumed to be zero-mean. The value of coherence function ranges between 0 and 1, with 1 indicating full coherence and 0 indicating no correlation between the two signals.

The coherence function is often referred to as the magnitude squared coherence (MSC) function. The MSC function has been used both by itself alone and in combination with a beamformer (see "A Two-Sensor Noise Reduction System: Applications for Hands-Free Car Kit", by A. Guérin, R. L. Bouquin-Jeannés and G. Faucon and "Digital Speech Transmission: Enhancement, Coding and Error Concealment," by P. Vary and D. R. Martin). The MSC function has been used in two-microphone applications. The MSC function works on two main assumptions: Firstly, that the target speech signals are directional and thus there is a high coherence between the target speech signals received at different microphones. Secondly, that the noise signals are diffuse and thus have lower coherence between microphones than between the target speech signals. However, such an assumption has many limitations. For example, in modelling ambient noise, with the assumption of an ideal diffuse noise field, the coherence function, i.e. MSC, can be expressed using a sin c function:

$$Coh(\Omega) = \frac{\sin^2(\Omega f_s d/c)}{(\Omega f_s d/c)^2} \quad (2)$$

where $$\Omega = \frac{2\pi f}{f_s},$$

d, c, and fs denote the distance between the omni-directional microphones, the speed of sound, and the sampling rate, respectively.

The coherence function of the ideal diffuse sound field attains its first zero at $$f_c = \frac{c}{2d}.$$

Above this frequency $f_c$, the function value, i.e. the coherence, is low. For a typical Bluetooth headset, the microphones are separated by a distance of 2.5 cm. In such a case, $f_c$ can be calculated to be 6860 Hz. Therefore, for this typical Bluetooth headset, even perfectly diffuse noise exhibits a high coherence and thus the coherence function is ineffective for distinguishing speech from acoustic noise from far field.

Filtering Based on Direction-of-Arrival

Direction-of-arrival (DOA) based filtering relies on the ability of the receiver to estimate the origin of a target signal. DOA estimation of a sound source by using microphone arrays has previously been applied to tackle speech enhancement problems. Examples of particular applications are illustrated in "Microphone Array for Headset with Spatial Noise Suppressor," by A. A. Ivan Tashev and Michael L. Seltzer, and "Noise Crosee PSD Estimation Using Phase Information in Diffuse Noise Field," by M. Rahmani, A. Akbari, B. Ayad and B. Lithogow. The fundamental principle behind DOA estimation is to capture the phase information present in signals picked up by the array of microphones. The phase difference is zero when the incoming signal impinges from the broadside direction, and largest when the microphones are in end-fire orientation. The phase difference is often estimated through the so called phase transform (PHAT). PHAT normalises the cross-spectrum by the total magnitude of the cross-spectrum.

In practice, it is difficult to accurately estimate the phase of a received signal due to reverberation, quantisation and hardware limitations of the receiver. Also, systems that filter based on the DOA estimate can be ineffective in cancelling noise signals that originate from the same direction as the target signal. Therefore, when the target signal is from the broadside direction, i.e., zero phase difference, the array is also limited in reducing diffuse noise.

Hybrid Approach

Realizing the limitations of various multi-microphone noise suppression approaches, hybrid systems have also been proposed. In "Blind Source Separation combining Frequency-Domain ICA and Beamforming", by H. Saruwatari, S. Kurita, and K. Takeda, a subband BSS/ICA system is combined with a null beamformer. The selection of the demixing matrices used in BSS/ICA is selected based on the estimated DOA of the undesired sound source. Such an approach may have problems in practice when the input signals have a random phase distribution, such as wind noise. The ICA would fail to converge due to the sporadic and highly incoherent nature of wind noise. In "Microphone Array for Headset with Spatial Noise Suppressor," by A. A. Ivan Tashev and Michael L. Seltzer, a second hybrid algorithm is described. This second hybrid algorithm consists of a three stage processing chain: a fixed beamformer, a spatial noise suppressor for removing directional noise sources and a single-channel adaptive noise reduction module designed to remove any residual ambient or instrumental stationary noise. Both the beamformer and the spatial noise suppressor are designed to remove from the signal noise components that arrive from directions other than the main signal direction. Therefore, this system may experience difficulties in suppressing noise when the noise signal is in the target signal direction. This might be true for non-stationary noise sources, such as wind, music and interfering speech signals.

From the discussion above, most of these approaches have limited capability handling wind buffeting noise, and their capabilities of reducing acoustic noise are greatly hampered when wind buffeting exists. Out of the techniques that can reduce wind buffeting noise, their capability in reducing acoustic noise would be seriously compromised by reducing wind buffeting noise.

There is therefore a need for a system for mitigating the effect of wind buffeting noise.

SUMMARY OF THE INVENTION

In a first aspect of the present invention, there is provided a method of compensating for noise in a receiver comprising a first receiver unit and a second receiver unit, the method comprising: receiving a first transmission at the first receiver unit, the first transmission having a first signal component and a first noise component; receiving a second transmission at the second receiver unit, the second transmission having a second signal component and a second noise component; determining whether the first noise component and the second noise component are incoherent and; only if it is determined that the first and second noise components are incoherent, processing the first and second transmissions in a first processing path, wherein the first processing path compensates for incoherent noise.

Preferably, if the determination indicates that the first and second noise components are coherent, the method further comprises processing the first and second transmissions in a second processing path, wherein the second processing path compensates for coherent noise.

Preferably, if it determined that the first noise component and the second noise component are incoherent, a first control signal is generated, wherein the generation of the first control signal causes the first and second transmissions to be processed in the first processing path whereas, if it determined that the first noise component and second noise component are coherent, a second control signal is generated, wherein the generation of the second control signal causes the first and second transmissions to be processed in the second processing path.

Preferably, the first processing path comprises a first gain attenuator arranged to apply gain coefficients to at least part of the first and second transmissions and wherein the gain coefficients are determined in dependence on the determination of whether the first noise component and the second noise component are incoherent.

Preferably, the step of determining whether or not the first and second transmissions are incoherent generates a control signal, wherein the control signal has a finite value and the control signal indicates that the first and second noise components are incoherent if the finite value is smaller than a threshold value.

Preferably, the step of determining whether or not the first and second transmissions are incoherent involves applying an algorithm based on the coherence function to the first and second transmissions.

Preferably, the step of determining whether or not the first and second transmissions are incoherent involves applying an algorithm based on the direction of arrival of the first and second transmissions.

Preferably, the first processing path comprises a channel fusion device and wherein, in the frequency domain, the first transmission is composed of a first plurality of frequencies and the second transmission is composed of a second plurality of frequencies, and the method further comprises: generating a composite signal in the channel fusion device from the first transmission and the second transmission, wherein the composite signal is formed by: grouping together first sets of contiguous frequencies from the first plurality of frequencies, wherein the respective sets are non-overlapping in frequency; grouping together second sets of contiguous frequencies from the second plurality of frequencies, wherein the respective sets are non-overlapping in frequency; analysing the first noise component in the first sets and the second noise components in the second sets and, for each set, selecting the first signal component for the composite signal if the first noise component is less than the second noise component or selecting the second signal component for the composite signal if the second noise component is less than the first noise component.

Preferably, the composite signal is only generated if at least two of the following conditions are true:

a) the receiver determines that the first and second transmissions are incoherent;
b) the receiver determines that the wind speed is large;
c) the receiver determines that a non-stationary event is present in the signal by comparing the first and second transmissions to background noise; and
d) the receiver determines that there is a large energy signal present in the frequency domain at lower frequencies of the first and second transmissions, relative to the respective transmission as a whole.

Preferably, the wind speed is determined to be large if either the difference in power between the first and second transmissions exceeds a threshold or in dependence on a comparison of the first and second transmissions with a predetermined spectral shape.

Preferably, the second signal processing path comprises a second gain attenuator arranged to apply gain coefficients to the first and second transmissions and wherein the gain coefficients are determined in dependence on the direction of arrival of the first transmission and the second transmission.

Preferably, the second processing path further comprises a BSS/ICA unit and the BSS/ICA unit suppresses coherent noise in the first and second transmissions.

Preferably, the extent to which the BSS/ICA unit suppresses noise component in the first transmission and the second transmission is further dependent on a smoothed control signal, the smoothed control signal being related to the control signal in the following manner:

$$C_s(t)=C_s(t-1)+a_{attack}(C_t-C_s(t-1)) \text{ for } C_t>C_s(t-1); \text{ and} \quad \text{a)}$$

$$C_s(t)=C_s(t-1)+a_{decay}(C_t-C_s(t-1)) \text{ for } C_t<C_s(t-1); \quad \text{b)}$$

where $C_s(t)$ represents the smoothed control value, $C_t$ represents the control signal and $a_{attack}$ and $a_{decay}$ are predetermined factors which have the relationship $a_{attack}<a_{decay}$.

Preferably, the smoothed control signal is configured such that if the smoothed control value is smaller than a predefined threshold, the BSS/ICA unit is disabled.

Preferably, the BSS/ICA unit has an adaptation step size that is used to control the estimation of the filter coefficients and wherein the adaptation step size is multiplied by $C_s(t)$.

Preferably, the second processing path comprises a channel fusion device and wherein, in the frequency domain, the first transmission is composed of a first plurality of frequencies and the second transmission is composed of a second plurality of frequencies, and the method further comprises: generating a composite signal in the channel fusion device from the first transmission and the second transmission, wherein the composite signal is formed by: grouping together first sets of contiguous frequencies from the first plurality of frequencies, wherein the respective sets are non-overlapping in frequency; grouping together second sets of contiguous frequencies from the second plurality of frequencies, wherein the respective sets are non-overlapping in frequency; analysing the first noise component in the first sets and the second noise components in the second sets and for each set, selecting the first signal component for the composite signal if the first noise component is less than the second noise component or selecting the second signal component for the composite signal if the second noise component is less than the first noise component.

Preferably, both the transmission fusion device and the BSS/ICA unit separately process the first and second transmissions to form transmission fusion results and BSS/ICA results respectively, and the transmission fusion gain results and the BSS/ICA results are combined by assigning a weight of $C_s(t)$ to the signal outputted from the BSS/ICA unit and by assigning a weight of $(1-C_s(t))$ to the signal outputted from the transmission fusion device.

In a second aspect of the present invention, there is provided a receiver comprising a first receiver unit, a second receiver unit and a first processing path, wherein the receiver is configured to: receive a first transmission at the first receiver unit, the first transmission having a first signal component and a first noise component; receive a second transmission at the second receive unit, the second transmission having a second signal component and a second noise component; determine whether the first noise component and the second noise component are incoherent and; only if it is determined that the first and second noise components are incoherent, process the first and second transmissions in a first processing path, wherein the first processing path is configured to compensate for incoherent noise.

Preferably, the receiver further comprises a second processing path that is configured to compensate for coherent noise and, if the determination indicates that the first and second noise components are coherent, the receiver is configured to process the first and second transmissions in a second processing path.

Preferably, if it is determined that the first noise component and the second noise component are incoherent, a first control signal is generated, wherein the generation of the first control signal causes the first and second transmissions to be processed in the first processing path whereas, if it is determined that the first noise component and the second noise component are coherent, a second control signal is generated, wherein the generation of the second control signal causes the first and second transmissions to be processed in the second processing path.

Preferably, the step of determining whether or not the first and second noise components are incoherent generates a control signal, wherein the control signal has a finite value and the control signal indicates that the first and second noise components are incoherent if the finite value is smaller than a threshold value.

Preferably, the first processing path comprises a channel fusion device and wherein, in the frequency domain, the first transmission is composed of a first plurality of frequencies and the second transmission is composed of a second plurality of frequencies, and the method further comprises: generating a composite signal in the channel fusion device from the first transmission and the second transmission, wherein the composite signal is formed by: grouping together first sets of contiguous frequencies from the first plurality of frequencies, wherein the respective sets are non-overlapping in frequency; grouping together second sets of contiguous frequencies from the second plurality of frequencies, wherein the respective sets are non-overlapping in frequency; analysing the first noise component in the first sets and the second noise components in the second sets and, for each set, selecting the first signal component for the composite signal if the first noise component is less than the second noise component or selecting the second signal component for the composite signal if the second noise component is less than the first noise component.

Preferably, the composite signal is only generated if at least two of the following conditions are true:

a) The receiver determines that the first and second transmissions are incoherent;
b) The receiver determines that the wind speed is large;
c) The receiver determines that a non-stationary event is present in the signal by comparing the first and second transmissions to background noise; and
d) The receiver determines that, relative to the first and second transmissions as a whole, there is a large energy signal present in the frequency domain at lower frequencies of the first and second transmissions.

Preferably, the receiver is configured to determine that the wind speed is large if either the difference in power between the first and second transmissions exceeds a threshold or following a comparison of the first and second transmissions with a predetermined spectral shape.

Preferably, the receiver determines whether or not the first and second transmissions are incoherent by applying an algorithm based on the coherence function to the first and second transmissions.

Preferably, the receiver determines whether or not the first and second transmissions are incoherent by applying an algorithm based on the direction of arrival of the first and second transmissions.

DETAILED DESCRIPTION OF THE INVENTION

Figure 1:
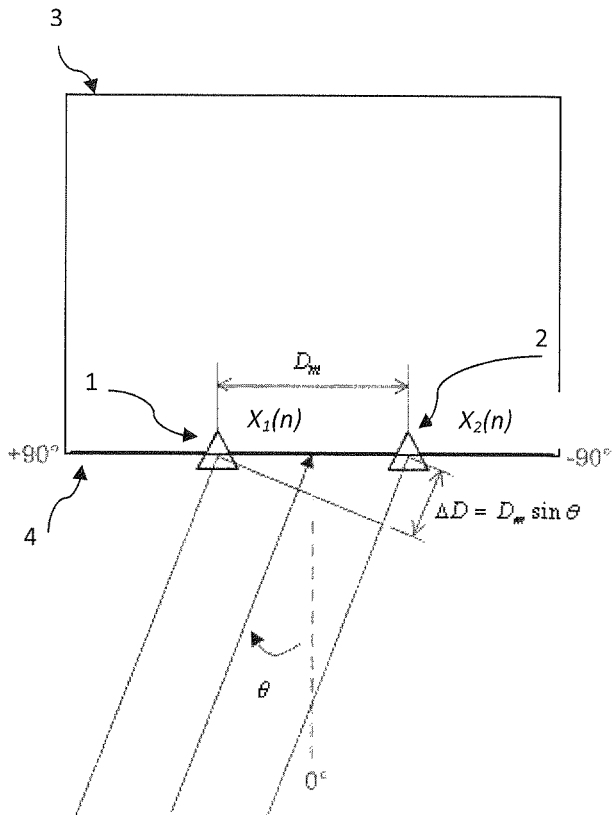
FIG. 1 illustrates a dual microphone receiver.

The following discloses two frequency-domain two-microphone based algorithms that are designed to help mitigate the wind buffeting problem:

i) Coherence processing, which detects and suppresses wind buffeting noise by tracking the coherence between signals observed by two microphones; and
ii) Directional filtering, which protects signals arriving from certain directions and filters out other signals, including wind buffeting noise.

These two algorithms can be implemented individually, or in conjunction with other algorithms since they are based on different but complementary information. These algorithms can be generalized and applied to the cases with three or more microphones. Both algorithms have low complexity and are suitable for embedded platforms, such as Bluetooth headsets, mobile phones, and hearing aide.

The following further discloses a unique multi-tier special filtering (MTSF) approach which better mitigates both wind buffeting and other acoustic noise: The wind buffeting mitigation algorithms proposed in the following can be used to detect wind buffeting and attenuate it when detected. If wind buffeting is not detected, the signals from the two microphones may be passed onto a module that extracts target signal from acoustic noise, such as the system proposed in US 2009/0271187.

The invention will now be further elaborated with reference to specific embodiments. Features in the different embodiments that are labelled with the same reference numeral are equivalent to each other.

A receiver is configured to receive an incoming transmission and to determine whether or not the incoming transmission comprises an incoherent noise component. The presence of an incoherent noise component is indicative of the presence of wind hitting the receiver. The receiver is configured to have two microphones (receivers). Each microphone will receive a different signal. For acoustic sources, such as speech, music, and background noise, the signal received by the respective microphone will depend on the microphone's position relative to the corresponding signal sources. The two microphone signals are fully coherent when there is only one acoustic source active. When several acoustic sources are active at the same time, each microphone will capture a mixture of these acoustic signals. This captured mixture is likely to be different at each microphone and thus the coherence between the signals received at the two microphones will be reduced relative to the single acoustic source model. The reduction in coherence is more significant when microphone distance is large or the acoustic sources are relatively close to the microphones. However, in general, the reduction in coherence is moderate. Therefore, acoustic signals can be referred to as coherent signals.

When wind hits the receiver, it causes local turbulence and generates wind buffeting noise at the microphones. As the wind buffeting noise is not generated through acoustic propagation, the wind buffeting noise components captured by the two microphones do not convey any information about a source location for the wind buffeting noise. These wind buffeting noise components also do not exhibit much coherence between them. Therefore, wind buffeting noise can be referred to as incoherent signals.

To determine whether or not the incoming signals comprise an incoherent noise, the receiver may be configured to perform coherence processing. Alternatively, the receiver may be configured to determine whether or not the incoming signals comprise an incoherent noise by performing directional filtering. Alternatively, the receiver may be configured to determine whether or not the incoming signals comprise an incoherent noise by performing both coherence processing and directional filtering. These techniques are described in the following.

Coherence Processing

If the signals captured by the two microphones are denoted as $x_1(n)$ and $x_2(n)$ in the time domain, the coherence function between the two signals at frequency band k is defined as:

$$Coh(k) = \frac{|E\{X_1(k)X_2*(k)\}|^2}{E\{|X_1(k)|^2\}E\{|X_2(k)|^2\}} \tag{1}$$

where, as before, E{ } denotes expectation value, superscript * denotes complex conjugate, and $X_i(k)$ is the frequency-domain representation of $x_i(n)$ at frequency band k and is assumed to be zero-mean. The values of the coherence function range between 0 and 1, with 1 indicating full coherence and 0 indicating no correlation between the two signals.

Consider the simplest case of having two independent active signal sources in the acoustic environment. If $s_A(n)$ and $s_B(n)$ denote the signals from sources A and B captured at microphone 1. It can be assumed that the source signals captured at microphone 2 are linearly transformed versions of $s_A(n)$ and $s_B(n)$ respectively. Therefore, the two microphone signals can be modelled as:

$$X_1(k)=S_A(k)+S_B(k)$$

$$X_2(k)=H_A(k)S_A(k)+H_B(k)S_B(k) \tag{3}$$

where $H_A(k)$ and $H_B(k)$ represent the corresponding linear transformations. Thus:

$$\left.\begin{aligned} E\{|X_1(k)|^2\} &= P_A(k) + P_B(k) \\ E\{|X_2(k)|^2\} &= E\{|H_A(k)|^2\}P_A(k) + E\{|H_B(k)|^2\}P_B(k) \\ E\{X_1(k)X_2^*(k)\} &= E\{H_A^*(k)\}P_A(k) + E\{H_B^*(k)\}P_B(k) \end{aligned}\right\} \tag{4}$$

where $P_I(k)=E\{|S_I(k)|^2\}$, I=A or B, and E{•} represents the expectation operator. Based on Eq. (4), the coherence function in Eq. (1) can be expanded as:

$$Coh = \frac{|E\{H_A\}|^2 P_A^2 + |E\{H_B\}|^2 P_B^2 + (E\{H_A\}E\{H_B^*\} + E\{H_A^*\}E\{H_B\})P_A P_B}{E\{|H_A|^2\}P_A^2 + E\{|H_B|^2\}P_B^2 + (E\{|H_A|^2\} + E\{|H_B|^2\})P_A P_B} \tag{5}$$

where the frequency band index (k) has been dropped for simplicity.

When both sources A and B are acoustic signals, the transformations $H_A(k)$ and $H_B(k)$ convey spatial information. The spatial information provides information on where the signal sources are in relation to the two microphones and can be treated as constant over a short period of time. The expectation sampling window employed by the system may be chosen so that the transformations $H_A(k)$ and $H_B(k)$ remain constant. Therefore, the expectation operations on $H_A(k)$ and $H_B(k)$ can be ignored and thus Eq. (5) can be simplified as $$Coh = \frac{|H_A|^2 P_A^2 + |H_B|^2 P_B^2 + (H_A H_B^* + H_A^* H_B)P_A P_B}{|H_A|^2 P_A^2 + |H_B|^2 P_B^2 + (|H_A|^2 + |H_B|^2)P_A P_B} \tag{6}$$

The numerator and the denominator only differ in the $P_A P_B$ (third) terms. This indicates that significant coherence generally exists between the two microphone signals. This is especially true when one of the signals dominates ($P_A(k)>>P_B(k)$ or $P_B(k)>>P_A(k)$) or when the transformations are similar ($H_A(k)\approx H_B(k)$). When the two microphones are closely spaced, both transformations would be close to identity $H_A(k)\approx H_B(k)\approx 1$). Therefore, in general, the coherence is expected to be close to 1.

When one of the sources is the wind buffeting noise, the transformation associated with this source would be fast changing and volatile. For example, if source B is the wind buffeting noise, $H_B(k)$ would be fast changing in a random pattern. Thus the expectation operation for $H_B(k)$ cannot be ignored and, due to the large variance of $H_B(k)$, $|E\{H_B\}|^2 << E\{|H_B|^2\}$. If the wind buffeting noise dominates acoustic signals ($P_B(k)>>P_A(k)$), the $P_B^2$ terms in Eq. (5) would dominate and drive the coherence toward 0.

Therefore, the coherence provides an excellent mechanism for detecting and reducing wind buffeting noise. The coherence function Coh(k) can be compared to a threshold Th(k) such that when Coh(k)<Th(k), the frequency band k is considered to be under the influence of wind buffeting. By further comparing the power of microphone signals in the frequency band k, the microphone with the larger power is considered to be subject to wind buffeting. To mitigate the effect of wind buffeting, the larger power signal can be attenuated. Alternatively, the effect of wind buffeting can be mitigated by substituting the larger power signal with comfort noise. The threshold Th(k) can be decided by analyzing Eq. (6) based on known constraints, such as microphone configuration and target signal locations. It can also be determined empirically.

Alternatively, or preferably in addition, the coherence function Coh(k) or a warped version of it can be applied to attenuate the microphone signal with higher power at the frequency band k. The coherence function may be warped in at least any of the following ways:

1. $Coh^2(k)$ can be used for aggressive attenuation;
2. sqrt(Coh(k)) can be used for conservative attenuation; or
3. max(min(2 $Coh^2(k)$,1),0) can be used for more aggressive attenuation when Coh(k)<0.5, but more conservative attenuation when Coh(k)>0.5;

Similar to the threshold, the warping of the coherence function can be determined either empirically or by analyzing Eq. (6) based on known acoustic constraints. For example, if the distance between the microphones is large and if the acoustic source is relatively close to the microphones, the receiver may be configured to apply attenuation only when Coh(k) is very close to 0. This is because the coherence can drop to moderate levels even without wind buffeting. Conversely, if the microphone distance is small and the signal sources are relatively far away, attenuation can be applied when Coh(k) drops slightly below 1. This is because, without wind buffeting, the coherence should stay close to 1.

In applications where wind buffeting generally impacts across all frequency bands, the threshold or warping process can be applied to the coherence function. Preferably, the threshold or warping process can be applied to an average Coh(k) across all k. The threshold or warping process can be applied to a weighted average of Coh(k) across all k. The threshold or warping process can be applied to a unweighted average of Coh(k) across all k. Suitably, the determined result is applied to all frequency bands.

The aggressiveness of the threshold or warping process discussed above can be made variable depending on other detection algorithms, such as the directional filtering described below. Alternatively, instead of being used as gain factors that are applied to signals, the results of the threshold or warping process discussed above can be used as a hard or soft decision that controls the aggressiveness of other wind mitigation algorithms such as the directional filtering technique outlined below. The preferred combination depends on specific audio apparatus designs and their targeted acoustic environments.

Directional Filtering

As discussed above, when microphone distance becomes large, the coherence processing needs to be more conservative in order to protect signal integrity. This reduces the effectiveness of coherence processing against wind buffeting noise. Fortunately, larger microphone spacing also provides better spatial resolution. Therefore, if the direction of arrival (DOA) of the target signals is constrained, directional filtering can be used to replace or supplement coherence processing.

As illustrated in FIG. 1, two microphones 1, 2, in a receiver 3 are placed on a base line 4 with the distance between them denoted as $D_m$. In the following, the DOA that is perpendicular to the base line is designated as 0° and clockwise rotation is designated as giving a positive angle. If a signal of frequency f comes in at the direction θ, the extra distance for it to arrive at microphone 2 after reaching microphone 1 would be equal to $\Delta D = D_m \sin\theta$. Therefore, as the wavelength of the signal would be $\lambda = v/f$ (where v is the speed of sound), the phase difference of microphone signals $x_1(n)$ and $x_2(n)$ would be:

$$\phi_{x1} - \phi_{x2} = \frac{2\pi\Delta D}{\lambda} = \frac{2\pi f D_m \sin\theta}{v} \tag{7}$$

It should be noted that this model assumes that the signal propagates as a plane wave. When the signal source is near the microphones, the signal would behave like a spherical wave and thus the relative delay would increase. This added delay is more obvious when θ≈±45° and less so when θ≈0° or θ≈±90°

For a band limited signal ($f_{min}<f<f_{max}$) that is expected to have a DOA angular range of θ, where $\theta_{min}<\theta<\theta_{max}$, the phase difference $\phi_{x1}-\phi_{x2}$ between $x_1(n)$ and $x_2(n)$ has the range of:

$$\Delta\phi_{min} = \frac{2\pi f_{min} D_m \sin\theta_{min}}{v} < \phi_{x1} - \phi_{x2} < \frac{2\pi f_{max} D_m \sin\theta_{max}}{v} = \Delta\phi_{max} \tag{8}$$

if $0<\theta_{min}<\theta_{max}$, $$\Delta\phi_{min} = \frac{2\pi f_{max} D_m \sin\theta_{min}}{v} < \phi_{x1} - \phi_{x2} < \frac{2\pi f_{max} D_m \sin\theta_{max}}{v} = \Delta\phi_{max} \tag{8'}$$

if $\theta_{min}<0<\theta_{max}$, or $$\Delta\phi_{min} = \frac{2\pi f_{max} D_m \sin\theta_{min}}{v} < \phi_{x1} - \phi_{x2} < \frac{2\pi f_{min} D_m \sin\theta_{max}}{v} = \Delta\phi_{max} \tag{8''}$$

if $\theta_{min}<\theta_{max}<0$

For convenience of discussion, the following assumes the first case (Eq. (8)), but the latter two cases can be similarly deduced. Because wind buffeting noise is the results from local turbulence around microphones, the phase difference between the two microphone signals is randomly distributed. Therefore, a significant amount of wind buffeting noise can be filtered out based on Eq. (8) if the range for 0 is sufficiently constrained. In practice, because speech and audio signals are wide-band in nature, the signals received at the microphones must first be decomposed into frequency subbands before the criteria in Eq. (8) are applied to each subband. If the received signals are not first decomposed, the results obtained may not provide useful filtering results.

If a discrete Fourier transform (DFT) of size M is used to decompose a signal of sampling frequency $F_s$, the k-th frequency coefficient (0<k<M/2) would have an effective bandwidth of $(k-)F_s/M<f<(k+1)F_s/M$. Therefore, the range in Eq. (8) can be expressed as:

$$\Delta\phi_{min,k} = \frac{2\pi F_s D_m \sin\theta_{min}}{vM}(k-1) < \angle E\{X_1(k)X_2^*(k)\} < \tag{9}$$

-continued $$\frac{2\pi F_s D_m \sin\theta_{max}}{vM}(k+1) = \Delta\phi_{max,k}$$

Where $\angle E\{X_1(k)X_2^*(k)\}$ represents the phase difference $\Delta\phi_{x1x2,k}=\phi_{x1,k}-\phi_{x2,k}$ between $x_1(n)$ and $x_2(n)$ in the k-th frequency band.

The boundaries $\Delta\phi_{min,k}$ and $\Delta\phi_{max,k}$ are constants and can be pre-computed offline. A decision rule $G_{df}(k)$ can be developed by comparing the estimated phase differences $\Delta\phi_{x1x2,k}=\angle E\{X_1(k)X_2^*(k)\}$ to these boundaries. A decision based on Eq. (9) can then be expressed as:

$$G_{df}(k)=1-\min(\max(\max(\Delta\phi_{min,k}-\Delta\phi_{x1x2,k},\Delta\phi_{x1x2,k}-\phi_{max,k})0),\Delta\phi_{tr,k})/\Delta\phi_{tr,k} \quad (10)$$

Here a transition zone $\theta_t$, is introduced to smooth out the decision, which leads to the $\Delta\phi_{tr,k}$ term in Eq. (10). It is a pre-computed constant defined as:

$$\Delta\phi_{tr,k} = \frac{2\pi F_s D_m \sin\theta_{tr}}{vM}(k+1) \quad (11)$$

Figure 2:
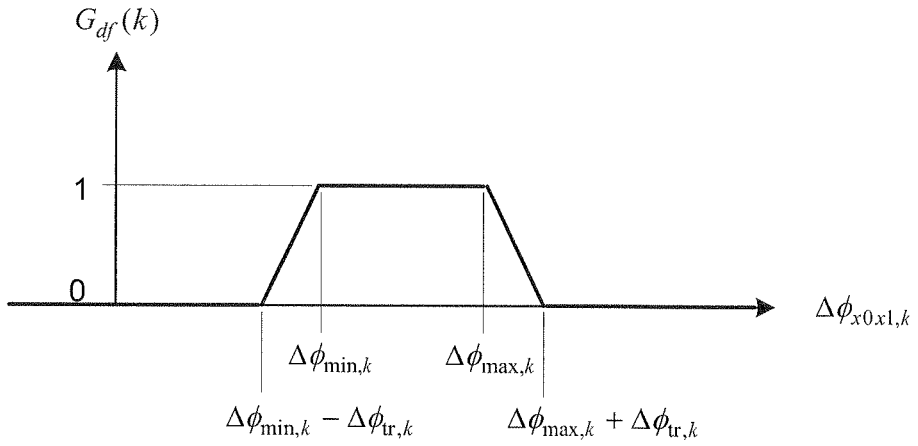
FIG. 2 illustrates an example of a control function.

The decision rule in Eq. (10) is illustrated in FIG. 2. Multiple sets of $\theta_{min}$ and $\theta_{max}$ can be used to compute multiple $G_{df}(k)$ if there is more than one target signal to be acquired.

The value of phase wraps around in the range (−p,p). This makes the implementation of Eq. (10) complicated. Therefore, it is advantageous to pre-rotate the signals such that the expected ranges of phase differences are centred on 0. This can be achieved by converting $X_2(k)$ into:

$$X_2'(k) = X_2(k)e^{j\frac{\Delta\phi_{max,k}+\Delta\phi_{min,k}}{2}} \quad (12)$$

and re-defining $\Delta\phi_{x1x2,k}$ as $\Delta\phi_{x1x2,k}=\angle E\{X_1(k)X_2'^*(k)\}$. As a result, Eq. (10) can be implemented more easily as:

$$G_{df}(k)=1-\min(\max(|\Delta\phi_{x1x2,k}|-\Delta\phi_{B,k},0),\Delta\phi_{tr,k})/\Delta\phi_{tr,k} \quad (13)$$

where $\Delta\phi_{B,k}=(\Delta\phi_{max,k}-\Delta\phi_{min,k})/2$

The direction-based decision $G_{df}(k)$ gives an indication on the coherence between the signals received by the two microphones. Therefore, $G_{df}(k)$ can be compared to an empirically decided threshold Th(k). When $G_{df}(k)<Th(k)$, the frequency band k is considered to be under the influence of wind buffeting. By further comparing the power of microphone signals in the frequency band k, the microphone with the larger signal power is considered to be the most subjected to wind buffeting. Therefore, this signal is attenuated. Alternatively, the signal could be substituted with comfort noise. Alternatively, $G_{df}(k)$ can be used as a gain factor to attenuate the wind buffeting noise. Alternatively, a warped version of $G_{df}(k)$ can be used as a gain factor to attenuate the wind buffeting noise. The threshold or warping discussed here can be constant. The threshold or warping discussed here can be adjusted in aggressiveness based on the indication from other algorithms. One of the other algorithms may be the coherence processing discussed above.

In applications where wind buffeting generally impacts across all frequency bands, the threshold or warping process can be applied to $G_{df}(k)$. Preferably, the threshold or warping process can be applied to an average $G_{df}(k)$ across all k. The threshold or warping process can be applied to a weighted average of $G_{df}(k)$ across all k. The threshold or warping process can be applied to a unweighted average of $G_{df}(k)$ across all k. Suitably, the determined result is applied to all frequency bands.

Alternatively, instead of being used as gain factors that are applied to signals, the results of the threshold or warping process on $G_{df}(k)$ can be used as a hard decision to control the aggressiveness of other wind mitigation algorithms. Alternatively, the results of the threshold or warping process on $G_{df}(k)$ can be used as a soft decision to control the aggressiveness of other wind mitigation algorithms. One of the other wind mitigation algorithms may be the coherence processing technique discussed above. The preferred combination depends on specific audio apparatus designs and their targeted acoustic environments.

Figure 5:
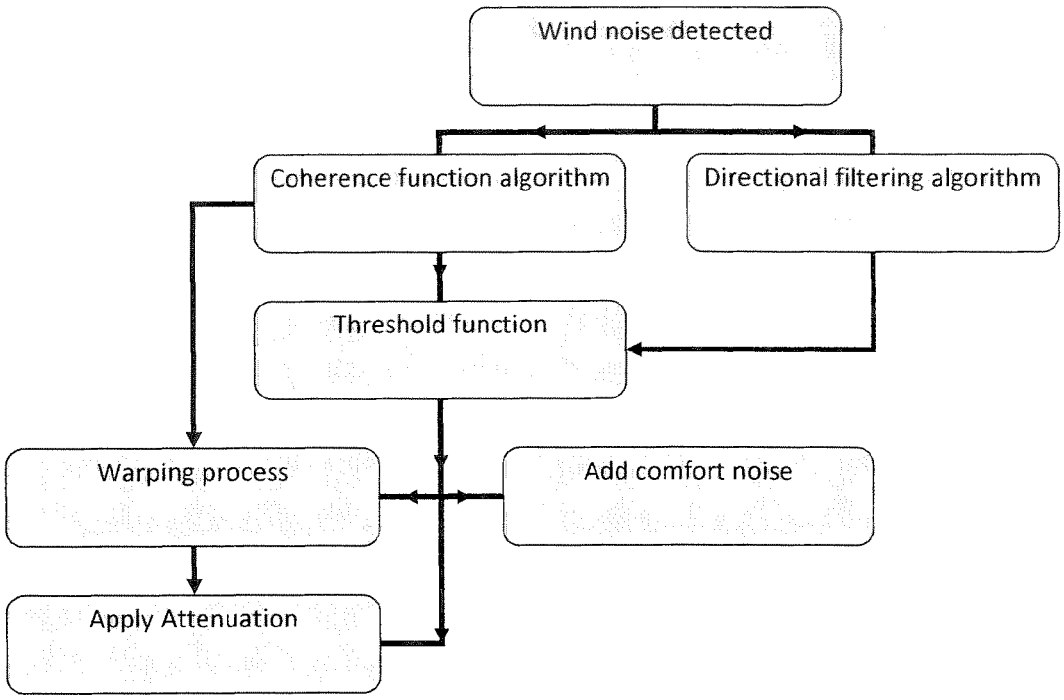
FIG. 5 illustrates a possible method to be applied to mitigate the effect of wind noise on received transmissions.

Preferably, there is a receiver comprising a first microphone and a second microphone. Preferably, the first microphone is arranged to receive a first transmission and the second microphone is arranged to receive a second transmission. It is expected that the first transmission comprises a first wind noise component and the second transmission comprises a second wind noise component. Preferably the receiver is configured to mitigate the effect of wind noise of the received transmissions by implementing either a coherence function algorithm or a directional filtering algorithm. Preferably, the first transmission is associated with a first power and the second transmission is associated with a second power. Preferably, the receiver is configured to select either the first transmission or the second transmission in dependence on the first and second power. Preferably, the transmission associated with the higher valued of the first and second power is selected by the receiver. Preferably, the noise component of the selected transmission is mitigated by applying at least one of the coherence function algorithm and the directional filtering algorithm. Preferably the at least one of the coherence function algorithm and the directional filtering algorithm is applied when the wind noise component has a value greater than a threshold value. Preferably, the algorithms may be altered in dependence on known acoustic constraints. Known acoustic constraints includes details of the first and second transmission source(s). Preferably, the algorithms may be altered in dependence on the relative positions of the first and second microphones. Preferably, the algorithms may be altered based on the value of the wind noise component. Preferably, the altered algorithms may be applied if the first and second wind noise components are detected. Preferably, when wind noise is detected, similar method steps to those outlined in FIG. 5 can be performed. Preferably, following a comparison of the value of the wind noise component of the selected transmission to a threshold value, the selected transmission is attenuated. Preferably, following a comparison of the value of the wind noise component of the selected transmission to a threshold value, a warped version of the selected algorithm is applied to the selected transmission, wherein the selected algorithm refers to the type of algorithm (i.e. coherence function or directional filtering) that the receiver is configured to apply to the selected transmission. Preferably, following a comparison of the value of the wind noise component of the selected transmission to a threshold value, at least part of the selected transmission is replaced with comfort noise. Preferably, the system may employ a transmission fusion technique. The transmission (or channel) fusion technique is outlined later in this application. Preferably, the receiver may apply either the coherence function algorithm or the directional filtering algorithm to the transmission obtained using the transmission fusion technique.

Multi-Tier Spacial Filtering (MTSF)

In light of the above, the presence of wind buffeting noise at the receiver can be deduced by determining the coherence of the signals. The coherence of the received signals can be determined using the coherence function techniques described above. Alternatively, the coherence of the received signals can be determined using the directional filtering techniques described above. The signals are determined to be incoherent, and thus wind buffeting noise is present in the received signals, if the determined coherence has a magnitude less than a threshold value. The signals are determined to be coherent if the determined coherence value has a magnitude greater than a threshold value. The threshold value may have a different magnitude for when the coherence function is used as compared to when directional filtering techniques are used.

If it is determined that the received signals are incoherent, the receiver is configured to process the received signals in a first processing path. Preferably, the received signals will only be passed to the first processing path if it is determined that the received signals are incoherent. If it is determined that the received signals are coherent, the receiver is configured to process the received signals in a second processing path. Preferably, the received signals will only be passed to the second processing path if it is determined that the received signals are coherent. Preferably, following the determination, the receiver is configured to generate a control signal. The control signal is used by the receiver to determine which processing path the received signals should be passed to. The control signal may be used to control a switch, where the position of the switch determines which processing path the received signals are passed to for processing.

Figure 3:
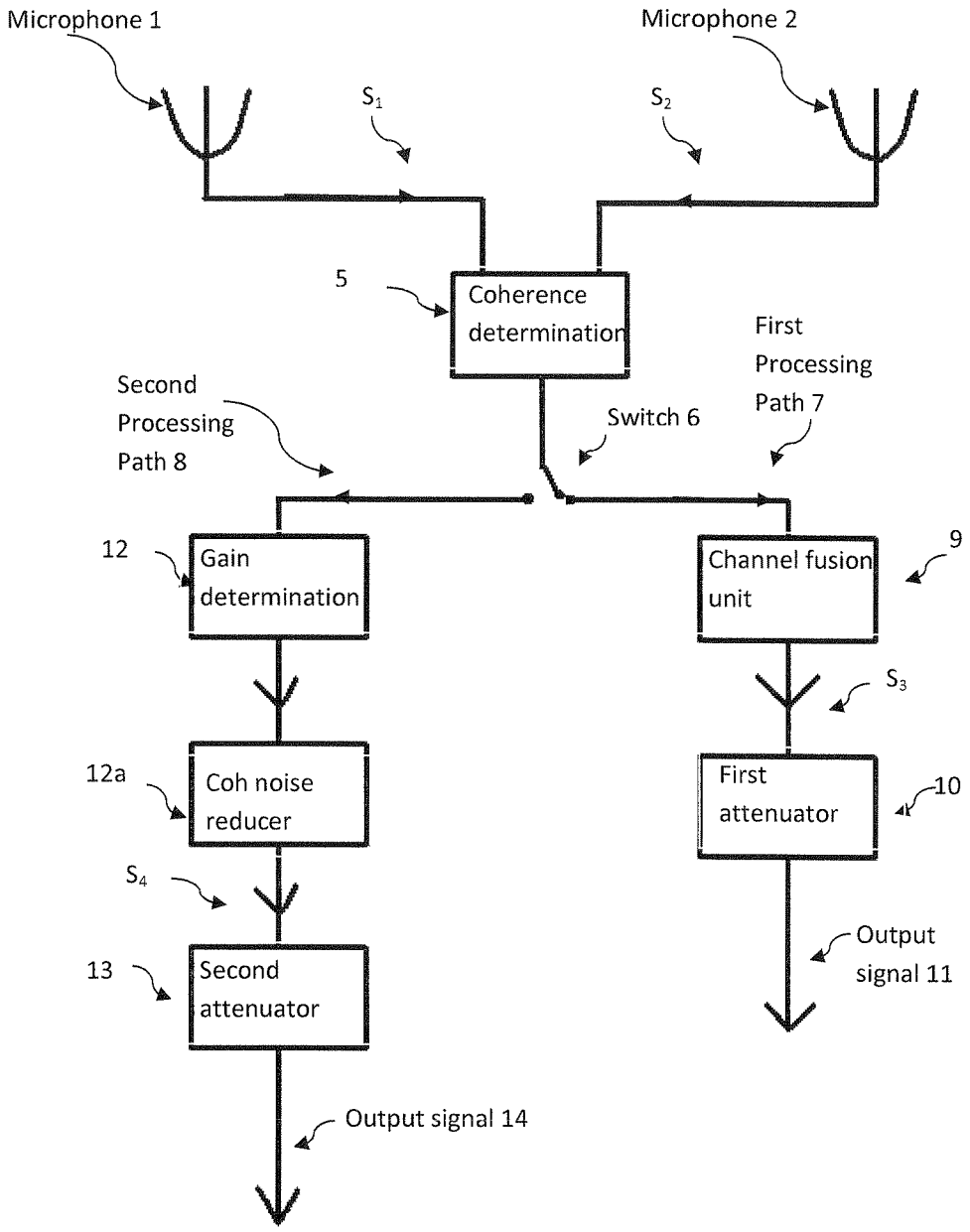
FIG. 3 illustrates a dual microphone receiver according to an embodiment of the present invention.

A preferred embodiment of the first processing path will now be described in more detail with reference to FIG. 3.

The receiver 3 comprises two microphones, 1, 2. Each microphone receives a signal ($S_1$ and $S_2$ respectively). $S_1$ and $S_2$ are passed to the first processing path only if it is determined that the received signals are incoherent. Preferably, this determination is made in a coherence determination unit 5. The coherence determination unit 5 may employ DOA techniques (such as the directional filtering) to determine whether or not $S_1$ and $S_2$ are incoherent. Alternatively, the coherence determination unit 5 may employ coherence function techniques (such as the coherence processing) to determine whether or not $S_1$ and $S_2$ are incoherent. Alternatively, both DOA and coherence function techniques may be employed to determine whether or not $S_1$ and $S_2$ are incoherent. The coherence determination unit 5 controls a switch 6. The position of the switch 6 determines whether $S_1$ and $S_2$ are passed along a first processing path 7 or a second processing path 8.

Preferably, the first processing path 7 comprises processing devices that are optimised for compensating for incoherent noise. This incoherent noise may be wind buffeting noise. Preferably, the processing devices in the first processing path 7 are a channel fusion unit 9 and a first attenuator 10. The channel fusion unit 9 is configured to divide each received signal ($S_1$ and $S_2$) into a plurality of subbands. Preferably the subbands in $S_1$ have the same width as the subbands in $S_2$. The subbands in $S_1$ and $S_2$ are then grouped into corresponding pairs e.g. subband 1 of $S_1$ and $S_2$ form a first corresponding pair, subband 2 of $S_1$ and $S_2$ form a second corresponding pair etc. The channel fusion unit then selects the subband of each pair that has the lowest noise value. Finally, the channel fusion unit collates the selected subbands to form a single signal $S_3$ for processing. This single signal $S_3$ will have a lower average noise component than either $S_1$ or $S_2$ individually. The single signal $S_3$ is then passed to first attenuator 10.

Preferably, the gain coefficients applied by first attenuator 10 are generated in dependence on the coherence determination made using Coh(k). Alternatively, the gain coefficients applied by first attenuator 10 are generated in dependence on the coherence determination made using $G_{df}(k)$. Alternatively, the gain coefficients applied by first attenuator 10 are generated in dependence on the coherence determination made using both Coh (k) and $G_{df}(k)$ It is not always preferable to operate the channel fusion unit 9. This is because the use of the channel fusion unit 9 can distort the desired data signal. Therefore, it is preferred that the channel fusion unit 9 be configured to operate only when certain constraints are met. If the constraints are not met, the channel fusion unit 9 may be configured to select either $S_1$ or $S_2$ for further processing, depending on which received signal has the lowest noise component. Alternatively, the channel fusion unit 9 passes both $S_1$ and $S_2$ through for further processing.

The first constraint is that the received signals $S_1$ and $S_2$ have a low coherency. This is generally true when $S_1$ and $S_2$ are passed to the first processing path. When the gain value, e.g. Coh(k), is low, it is likely that the two inputs have low coherence. A low coherence value indicates a potential incoherent noisy source, e.g. wind buffeting noise. In the context of directional filtering, the constraint becomes the phase difference between two input signals. Hence the gain value used here becomes $G_{df}(k)$. It should be noted that a combination of Coh(k) and $G_d$ (k) can also be used. Thus channel fusion is only performed when the gain values are low. The channel fusion unit 9 may be configured to be activated if the average gain values of some of the low frequency bins indicate that wind buffeting noise is present.

A second constraint relates to having a high speed wind. Whether or not the wind is high speed can be determined by analysing the power difference between the two input signals, $S_1$ and $S_2$. This analysis can be performed using both the long term power difference and the instantaneous power difference at the subband level i.e. in a particular frequency range. The long term power difference is the average power difference of several frames. This includes frames marked as containing wind noise by using the coherence determination. Although this power difference is called long term, the smooth time is actually very short since wind is highly non-stationary. The smooth time is the time period over which a quantised value set can be represented by a continuous value set in the time domain. The power difference is computed in the log domain. This corresponds to a power ratio in the linear domain. The power ratio is determined such that it represents the average power ratio for a plurality of frequency bins. Preferably the frequency bins in this plurality of frequency bins all occupy mid range frequencies, such as between 600 Hz and 2000 Hz. Mid-range frequencies are preferred as the observation of a significant power difference in this range renders it highly likely that the wind speed is high. Therefore, the benefit of channel fusion would outweigh its drawback, i.e. voice/data distortion. Once a large power has been detected in the received signal, the power difference is compared for each frequency bin. The frequency bins in the received signals that have a higher power than that of the secondary channel will then be swapped when performing the channel fusion operation. An adjustable margin can also be applied to the power of the received signals before comparison. This process will adjust the aggressiveness of the algorithm.

The third constraint is non-stationarity. Stationarity refers to the nature of the signal source. If the received signal remains constant over time, this is indicative of a stationary event. Wind noise is not considered to be stationary. Therefore, channel fusion is performed only when there is a non-stationary event. Stationarity can be measured by comparing the received signal power with the background quasi-stationary noise power ($P_k(I)$) in each subband.

$$q_k(l) = \begin{cases} \frac{|D_k(l)|^2}{P_k(l-1)} \exp\left(1 - \frac{|D_k(l)|^2}{P_k(l-1)}\right), & |D_k(l)|^2 > P_k(l-1) \\ 1, & \text{otherwise} \end{cases} \quad (14)$$

where $q_k(I)$ represents the stationarity, $D_k(I)$ represents the received signal power, $P_k(I)$ represents the noise power and I is the frame index used to indicate that function is being operated in the frequency domain. Noise power $P_k(I)$ can be estimated from the received signal $D_k(I)$ recursively by:

$$P_k(l)=P_k(l-1)+\alpha \cdot q_k(l) \cdot (|D_k(l)|^2|-P_k(l-1)) \quad (15)$$

where parameter $\alpha$ is a constant between 0 and 1 that sets the weight applied to each frame and $q_k(I)$, $P_k(I)$, and $D_k(I)$ have the same meaning as in equation 14. The value of the parameter $\alpha$ determines the minimum effective average time over which the stationarity is measured.

When the input signal energy is significantly higher than the noise estimate, the value $q_k(l)$ approaches zero. This corresponds to a non-stationary event. The non-stationary event could be speech. Alternatively, the non-stationary event could be wind buffeting noise. In contrast, a higher $q_k(l)$ value indicates that the input signal has similar power to the noise floor. A higher $q_k(l)$ value indicates that a stationary signal is present in the received signal.

It should be noted that various extensions can be made to Eq. (14). For example, in computing the ratio $$\frac{|D_k(l)|^2}{P_k(l-1)},$$

the power summation of several frequency bins can be used to improve robustness against spurious power fluctuations.

Other constraints can also be used when determining whether or not to perform a channel fusion operation. For example, since wind buffeting noise is dominated by low frequency components, wind buffeting noise can be detected by examining the power distribution in the frequency domain. The spectral shape of the power distribution in the frequency domain may then be used to determine the presence of wind buffeting noise. The channel fusion operation may also not be performed if a comparison of the two input signals $S_1$ and $S_2$ indicates that one of the received signals constantly contains a much stronger wind noise component than the other received signal. Channel fusion is also not desirable when the target speech signal in one of the received signals has been degraded. This could occur due to a hardware malfunction or when a user blocks one of the microphones.

Once the received signals have been processed in the channel fusion unit 9 and the first attenuator 10, the resultant signal 11 may be passed to further processing units in the receiver 3.

A preferred embodiment of the second processing path will now be described in more detail with reference to FIG. 3.

The receiver 3 comprises two microphones, 1, 2. Each microphone receives a signal ($S_1$ and $S_2$ respectively). $S_1$ and $S_2$ are passed to the second processing path only if it is determined that the received signals are coherent. Preferably, this determination is made in a coherence determination unit 5. The coherence determination unit 5 controls a switch 6. The position of the switch 6 determines whether $S_1$ and $S_2$ are passed along a first processing path 7 or a second processing path 8.

Preferably, the second processing path 8 comprises processing devices that are optimised for compensating for coherent noise. Preferably the second processing path 8 comprises a gain determination unit 12, a coherence noise reduction unit 12*a* and a second attenuator 13.

The second processing path 8 preferably comprises a gain determination unit 12. Preferably, the gain determination unit determines gain factors to be applied in second attenuator 13. Preferably, the gain determination unit determines gain factors to apply in second attenuator 13 using a directional filtering module with a phase difference constraint to select signals coming from certain target directions. Preferably, if a directional filtering algorithm has been used to determine whether or not the two received signals are coherent, this phase difference constraint imposes a greater constraint than the directional filtering algorithm that was used to determine whether or not the two received signals are coherent. In deriving the directional filtering earlier, the phase differential boundary was derived. However, if the DOA of the target signal is within a known range, the phase differential boundary can be narrowed to exclude acoustic noise signals from other directions. Preferably, the transition zone $\theta_{tr}$ is usually set to be much larger than for wind buffeting mitigation purpose. The larger transition zone reduces aggressiveness and thus avoids introducing too much distortion to the target signal.

The second processing path 8 preferably further comprises a coherent noise reduction unit 12*a*. Preferably, the coherent noise reduction unit is after the gain determination unit 12 and before the second attenuator 13. Preferably, the coherent noise reduction unit uses a BSS/ICA-based algorithm such as the one described in US 2009/0271187. Such a BSS/ICA-based algorithm can be used to extract the desired target signal from a signal containing the desired target signal and undesired acoustic noises. This is preferable as multi-microphone based BSS/ICA algorithms work particularly well for mixtures of point source signals, which are generally coherent across microphones. Although BSS/ICA algorithms are less efficient when incoherent noise is present and dominant, this is less of a consideration for signals that have been passed to the second processing path. When wind buffeting (incoherent) noise is excluded, the BSS/ICA algorithms can extract the desired target signal from other undesired acoustic noise effectively. This can be achieved based on the control signal $C_t$ generated in the coherence determination unit 5. The control signal is preferably a continuous value. Preferably, this continuous value is between 0 and 1, with larger control signal values indicating a lower probability of incoherent noise present in the signal. $C_t$ can be calculated by determining an average value of the coherence measurement. For example, in the case of directional filtering:

$$C_t = \underset{k}{mean} G_{df,t}(k) \quad (16)$$

where $G_{df,t}(k)$ is the directional filtering gain of frequency bin k at frame t. The control signal can also be a binary decision with 0/1 indicating the presence/absence of incoherent noise. For example, $$C_t = \begin{cases} 1, & \underset{k}{mean} G_{df,t}(k) > \text{Threshold} \\ 0, & \text{otherwise} \end{cases} \quad (17)$$

Preferably, the control signal is smoothed asymmetrically such that the system switches to the first processing path faster than the second processing path. By arranging the system thus, the receiver will have a fast response time for incoherent noise conditions. The smoothed control signal can be generated as in equation 18 below:

$$C_s(t) = \begin{cases} C_s(t-1) + \alpha_{attack}(C_t - C_s(t-1)), & C_t > C_s(t-1) \\ C_s(t-1) + \alpha_{decay}(C_t - C_s(t-1)), & C_t < C_s(t-1) \end{cases} \quad (18)$$

where $\alpha_{attack}$ and $\alpha_{decay}$ are predetermined factors. Preferably, these predetermined factors are between 0 and 1. Preferably, $\alpha_{attack}<\alpha_{decay}$.

The coherent noise reduction unit 12*a* may then be configured to be operated in any of the following ways:

1. The coherent noise reduction unit 12*a* may be disabled when $C_s(t)$ is smaller than a pre-defined threshold. When the coherent noise reduction unit 12*a* is disabled, either $S_1$, $S_2$, or a combination of $S_1$ and $S_2$ can be forwarded as $S_4$ to the second attunator 13.
2. The adaptation step size of BSS/ICA in the coherent noise reduction unit 12*a* may be multiplied by $C_s(t)$. This slows down the adaptation of the BSS/ICA algorithm and so slows the effect of any divergence of filter coefficients due to incoherent noise. Therefore, the negative effect of incoherent noise on the received signal is mitigated.
3. The BSS/ICA result from the second processing path 8 can be combined with the result from the first processing path 7. In this case the system output is a weighted sum of the result from the second processing path 8 (with weight $C_s(t)$) and the results from the first processing path 7 (with weight $(1-C_s(t))$).

Methods 2 and 3 can be used in conjunction with each other. Preferably, in method 3, both the first processing path 7 and the second processing path 8 are activated. Additionally, the attenuation factors generated by the gain determination unit 12 can be applied to the output $S_4$ of the coherent noise reduction unit 12*a* in the second attenuator 13. The application of the attenuation factors in the second attenuator 13 reduces the coherent noise component contained in the received signals $S_1$ and $S_2$ when the noise component is from a direction other than the direction of the target signal.

Once the received signals have been processed in the gain determination unit 12, coherent noise reduction unit 12*a*, and the second attenuator 13, the resultant signal 14 may be passed to further processing units in the receiver 3.

Figure 4:
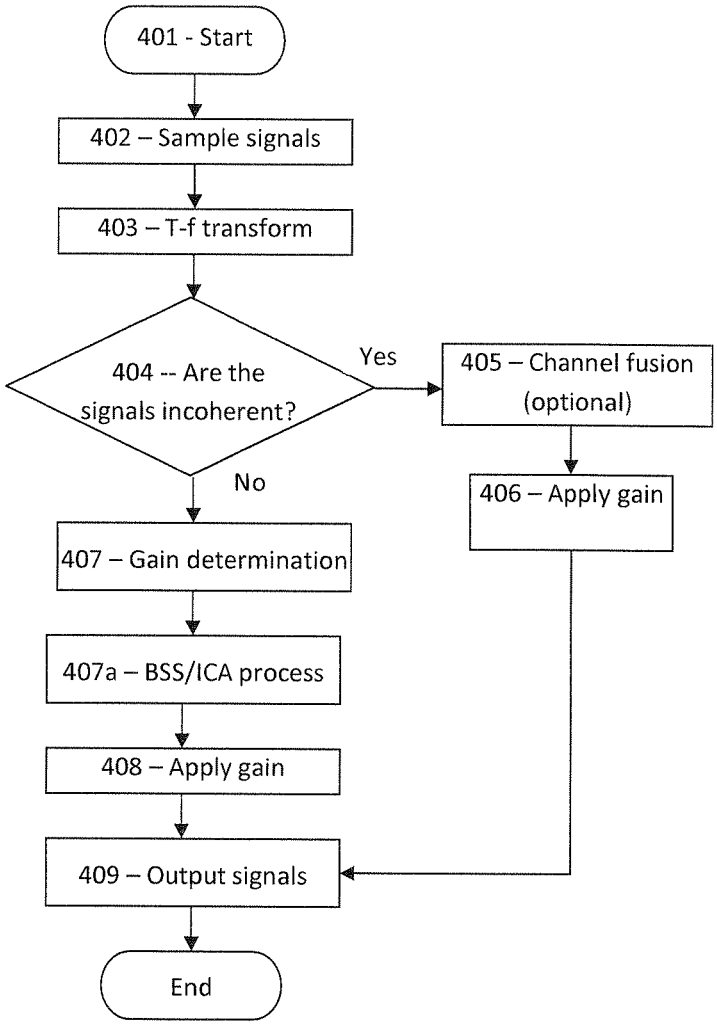
FIG. 4 illustrates some of the method steps employed by a receiver in an embodiment of the present invention.

FIG. 4 illustrates the method steps performed by the receiver following the receipt of transmissions at the first and second microphones. In step 401, signals $S_1$ and $S_2$ are received by the receiver. In step 402, the received signals are sampled. In step 403, a time-frequency transform of the sampled signals is performed. In step 404, it is determined whether the signals are coherent or incoherent.

If the received signals are determined to be incoherent, the process is directed to step 405. In step 405, the receiver may perform a channel fusion operation. The performance of the channel fusion operation may occur only in dependence on the receiver determining that the received signal comprises a high speed wind noise component and/or determining that the received signal comprises a highly non-stationary event. If the channel fusion operation is performed, the receiver processes the signal formed by the channel fusion operation. If the channel fusion operation does not occur, the receiver processes whichever received signal is determined to have the lowest noise component value. The process then proceeds to step 406. In step 406, the receiver applies gain coefficients to the signal selected for further processing. The gain coefficients applied may be determined based on the coherence determination performed in step 404. Finally, the method proceeds to step 409, where the signal is reconstructed for further processing.

If the received signals are determined to be coherent in step 404, the process proceeds to step 407. In step 407, the receiver determines which gain coefficients should be applied to the received signal. The receiver may determine these gain coefficients in dependence on gain coefficients determined using directional filtering techniques. In step 407*a*, the receiver may process the received signal using a BSS/ICA algorithm. The selected gain coefficients from step 407 are used in step 408 to attenuate the received signal. Finally, the method proceeds to step 409, where the signal is reconstructed for further processing.

If directional filtering is used for both determining the coherence of the incoming signals and for determining the gain coefficients to be applied to signals in the first processing path (coherence determination unit 5 in FIG. 3), the programming code can be shared by the coherence determination unit 5 and the gain determination unit 12. However, the angle range for directional filtering can be much narrower when applied in the gain determination unit 12. This is primarily due to the different purposes of the directional filtering in the two different processing units. The coherence determination unit 5 is configured to distinguish incoherent noise from acoustic (coherent) signals. Incoherent noise sources, such as wind buffeting noise, have phase differences that are evenly distributed between −p and p. However, acoustic signals are unlikely to have phase differences at some of these magnitudes, regardless of which direction they are from. On the other hand, gain determination unit 13 is configured to exclude acoustic signal from directions other than that of the target signal and so a narrower angle (phase difference) range can be applied. The attenuation factors determined for the first and second processing units are applied mutually exclusively: the gain coefficients determined for the first processing path (from coherence determination unit 5) are applied when incoherent noise is detected. If no incoherent noise (or only a small quantity of incoherent noise) is detected, the gain coefficients determined in the second processing path (from gain determination unit 12) are applied. The multiple processing unit structure allows for independent control over the transition zone parameters (i.e. specific conditions for coherent signals and for incoherent signals). For example, in the coherence determination unit 5, a narrower transition zone can be used to bring stronger attenuation when incoherent noise is detected, whereas a wider transition zone can be used when the received signals are highly coherent. This system allows the apparatus to avoid introducing excess distortion into the received signals.

An example configuration with directional filtering used in both processing units is given below. As illustrated in FIG. 1, two omni-directional microphones 1,2 are used in a Bluetooth headset 3. The microphones are separated by a distance of 2.5 cm. Assuming that the target signal is located in the direction of +90°:

for the coherence determination unit 5, the directional filtering angle range is [0°, +90°], for the gain determination unit 12, the directional filtering angle range is [+45°, +90°]

Preferably, the first and second processing units share as many of the same components as possible. Preferably, the first attenuator 10 and second attenuator 13 are the same device.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A method of compensating for noise in a receiver comprising a first receiver unit and a second receiver unit, the method comprising:

receiving a first transmission at the first receiver unit, the first transmission having a first signal component and a first noise component;

receiving a second transmission at the second receiver unit, the second transmission having a second signal component and a second noise component;

determining whether the first noise component and the second noise component include incoherent noise;

generating a control signal that indicates a probability of incoherent noise based on at least the incoherent noise determination for the first and second noise components;

if it is determined that the first and second noise components include incoherent noise, processing the first and second transmissions in a first processing path, wherein the first processing path compensates for incoherent noise; and if it is determined that the first and second noise components include incoherent noise, processing the first and second transmissions in a second processing path based at least on the control signal, wherein the second processing path compensates for incoherent noise in the first transmission and the second transmission dependent on a smoothed control signal that is related to the control signal.

2. The method as claimed in claim 1, wherein if the determination indicates that the first and second noise components are coherent, processing the first and second transmissions in the second processing path based at least on the control signal, wherein the second processing path compensates for coherent noise by suppressing the first and second noise components.

3. The method as claimed in claim 1, wherein if it is determined that the first noise component and the second noise component are incoherent, a first value for the control signal is generated, wherein the generation of the first value for the control signal causes the first and second transmissions to be processed in the first processing path whereas, if it is determined that the first noise component and the second noise component are coherent, a second value for the control signal is generated, wherein the generation of the second value for the control signal causes the first and second transmissions to be processed in the second processing path.

4. The method as claimed in claim 1, wherein the first processing path comprises a first gain attenuator arranged to apply gain coefficients to at least part of one of the first and second transmissions and wherein the gain coefficients are determined in dependence on the determination of whether the first noise component and the second noise component are incoherent.

5. The method as claimed in claim 1, wherein the control signal has a finite value and the control signal indicates that the first and second noise components are incoherent if the finite value is smaller than a threshold value.

6. The method as claimed in claim 1, wherein the step of determining whether or not the first and second transmissions are incoherent involves applying an algorithm based on a coherence function to the first and second transmissions.

7. The method as claimed in claim 1, wherein the step of determining whether or not the first and second transmissions are incoherent involves applying an algorithm based on a direction of arrival of the first and second transmissions.

8. The method as claimed in claim 1, wherein the first processing path comprises a channel fusion device and wherein, in a frequency domain, the first transmission is composed of a first plurality of frequencies and the second transmission is composed of a second plurality of frequencies, and the method further comprises:

generating a composite signal in the channel fusion device from the first transmission and the second transmission, wherein the composite signal is formed by:

grouping together first sets of contiguous frequencies from the first plurality of frequencies, wherein the respective sets are non-overlapping in frequency;

grouping together second sets of contiguous frequencies from the second plurality of frequencies, wherein the respective sets are non-overlapping in frequency;

analyzing the first noise component in the first sets and the second noise components in the second sets; and for each set, selecting the first signal component for the composite signal if the first noise component is less than the second noise component or selecting the second signal component for the composite signal if the second noise component is less than the first noise component.

9. The method as claimed in claim 8, wherein the composite signal is generated if at least two of the following conditions are true:

the receiver determines that the first and second transmissions are incoherent;

the receiver determines that a wind speed is large;

the receiver determines that a non-stationary event is present in a received signal by comparing the first and second transmissions to background noise; and the receiver determines that there is a large energy signal present in the frequency domain at lower frequencies of the first and second transmissions, relative to the respective transmission as a whole.

10. The method as claimed in claim 9, wherein the wind speed is determined to be large if either a difference in power between the first and second transmissions exceeds a threshold or in dependence on a comparison of the first and second transmissions with a predetermined spectral shape.

11. The method as claimed in claim 1, wherein the second signal processing path comprises a gain attenuator arranged to apply gain coefficients to the first and second transmissions and wherein the gain coefficients are determined in dependence on a determination of a direction of arrival of the first transmission and the second transmission.

12. The method as claimed in claim 11, wherein the second processing path further comprises a BSS/ICA unit and the BSS/ICA unit suppresses coherent noise in the first and second transmissions.

13. The method as claimed in claim 12, wherein an extent to which the BSS/ICA unit suppresses noise component in the first transmission and the second transmission is further dependent on the smoothed control signal, the smoothed control signal being related to the control signal in the following manner:

$$C_s(t)=C_s(t-1)+a_{attack}(C_t-C_s(t-1)) \text{ for } C_t>C_s(t-1); \text{ and}$$

$$C_s(t)=C_s(t-1)+a_{decay}(C_t-C_s(t-1)) \text{ for } C_t<C_s(t-1);$$

where $C_s(t)$ represents a smoothed control value, $C_t$ represents the control signal and $a_{attack}$ and $a_{decay}$ are predetermined factors which have a relationship $a_{attack}<a_{decay}$.

14. The method as claimed in claim 13, wherein the smoothed control signal is configured such that if the smoothed control value is smaller than a predefined threshold, the BSS/ICA unit is disabled.

15. The method as claimed in claim 13, wherein the BSS/ICA unit has an adaptation step size that is used to control an estimation of filter coefficients and wherein the adaptation step size is multiplied by $C_s(t)$.

16. The method as claimed in claim 13, wherein the second processing path comprises a channel fusion device and wherein, in a frequency domain, the first transmission is composed of a first plurality of frequencies and the second transmission is composed of a second plurality of frequencies, and the method further comprises:

generating a composite signal in the channel fusion device from the first transmission and the second transmission, wherein the composite signal is formed by:

grouping together first sets of contiguous frequencies from the first plurality of frequencies, wherein the respective sets are non-overlapping in frequency;

grouping together second sets of contiguous frequencies from the second plurality of frequencies, wherein the respective sets are non-overlapping in frequency;

analyzing the first noise component in the first sets and the second noise components in the second sets; and for each set, selecting the first signal component for the composite signal if the first noise component is less than the second noise component or selecting the second signal component for the composite signal if the second noise component is less than the first noise component.

17. The method as claimed in claim 13, wherein both the channel fusion device and the BSS/ICA unit separately process the first and second transmissions to form transmission fusion results and BSS/ICA results respectively, and the transmission fusion results and the BSS/ICA results are combined by assigning a weight of $C_s(t)$ to a signal outputted from the BSS/ICA unit and by assigning a weight of $(1-C_s(t))$ to a signal outputted from the channel fusion device.

18. A receiver comprising a first receiver unit, a second receiver unit and a first processing path, wherein the receiver is configured to:

receive a first transmission at the first receiver unit, the first transmission having a first signal component and a first noise component;

receive a second transmission at the second receive unit, the second transmission having a second signal component and a second noise component;

determine whether the first noise component and the second noise component include incoherent noise;

generate a control signal that indicates a probability of incoherent noise based on at least the incoherent noise determination for the first and second noise components;

if it is determined that the first and second noise components include incoherent noise, process the first and second transmissions in a first processing path, wherein the first processing path is configured to compensate for incoherent noise; and if it is determined that the first and second noise components include coherent noise, process the first and second transmissions in a second processing path based at least on the control signal, wherein the second processing path compensates for coherent noise in the first transmission and the second transmission dependent on a smoothed control signal that is related to the control signal.

19. The receiver as claimed in claim 18, wherein the receiver further comprises the second processing path that is configured to compensate for coherent noise by suppressing the first and second noise components based on the control signal and, if the determination indicates that the first and second noise components are coherent, the receiver is configured to process the first and second transmissions in a second processing path.

20. The receiver as claimed in claim 18, wherein if it is determined that the first noise component and the second noise component are incoherent, a first value for the control signal is generated, wherein the generation of the first value for the control signal causes the first and second transmissions to be processed in the first processing path whereas, if it is determined that the first noise component and the second noise component are coherent, a second value for the control signal is generated, wherein the generation of the second value for the control signal causes the first and second transmissions to be processed in the second processing path.

21. The receiver as claimed in claim 20, wherein the control signal has a finite value and the control signal indicates that the first and second noise components are incoherent if the finite value is smaller than a threshold value.

22. The receiver as claimed in claim 18, wherein the first processing path comprises a channel fusion device and wherein, in a frequency domain, the first transmission is composed of a first plurality of frequencies and the second transmission is composed of a second plurality of frequencies, and the method further comprises:

generating a composite signal in the channel fusion device from the first transmission and the second transmission, wherein the composite signal is formed by:

grouping together first sets of contiguous frequencies from the first plurality of frequencies, wherein the respective sets are non-overlapping in frequency;

grouping together second sets of contiguous frequencies from the second plurality of frequencies, wherein the respective sets are non-overlapping in frequency;

analyzing the first noise component in the first sets and the second noise components in the second sets; and for each set, selecting the first signal component for the composite signal if the first noise component is less than the second noise component or selecting the second signal component for the composite signal if the second noise component is less than the first noise component.

23. The receiver as claimed in claim 22, wherein the composite signal is generated if at least two of the following conditions are true:

the receiver determines that the first and second transmissions are incoherent;

the receiver determines that a wind speed is large;

the receiver determines that a non-stationary event is present in a received signal by comparing the first and second transmissions to background noise; and the receiver determines that, relative to the first and second transmissions as a whole, there is a large energy signal present in the frequency domain at lower frequencies of the first and second transmissions.

24. The receiver as claimed in claim 23, wherein the receiver is configured to determine that the wind speed is large if either a difference in power between the first and second transmissions exceeds a threshold or following a comparison of the first and second transmissions with a predetermined spectral shape.

25. The method as claimed in claim 18, wherein the receiver determines whether or not the first and second transmissions are incoherent by applying an algorithm based on a coherence function to the first and second transmissions.

26. The method as claimed in claim 18, wherein the receiver determines whether or not the first and second transmissions are incoherent by applying an algorithm based on a direction of arrival of the first and second transmissions.

* * * * *